US009039358B2

(12) United States Patent
Tholen et al.

(10) Patent No.: US 9,039,358 B2
(45) Date of Patent: May 26, 2015

(54) REPLACEABLE BLADE OUTER AIR SEAL DESIGN

(75) Inventors: Susan M. Tholen, Kennebunk, ME (US); Paul M. Lutjen, Kennebunkport, ME (US)

(73) Assignee: United Technologies Corporation, Hartford, CT (US)

( * ) Notice: Subject to any disclaimer, the term of this patent is extended or adjusted under 35 U.S.C. 154(b) by 1061 days.

(21) Appl. No.: 11/648,932

(22) Filed: Jan. 3, 2007

(65) Prior Publication Data

US 2008/0159850 A1 Jul. 3, 2008

(51) Int. Cl.

| | |
|---|---|
| ***F01D 11/08*** | (2006.01) |
| ***F01D 11/12*** | (2006.01) |
| ***F01D 11/16*** | (2006.01) |

(52) U.S. Cl.

CPC ..... *F01D 11/08* (2013.01); *F05D 2260/30* (2013.01); *F01D 11/12* (2013.01); *F01D 11/16* (2013.01)

(58) Field of Classification Search

CPC ..... F01D 11/08
USPC ..... 415/173.1, 173.3, 173.5, 174.2, 174.5, 415/200

See application file for complete search history.

(56) References Cited

U.S. PATENT DOCUMENTS

| | | | | |
|---|---|---|---|---|
| 899,319 | A * | 9/1908 | Parsons et al. | 415/173.5 |
| 994,029 | A * | 5/1911 | Parsons | 415/173.1 |
| 4,087,199 | A | 5/1978 | Hemsworth et al. | |
| 4,527,385 | A | 7/1985 | Jumelle et al. | |
| 4,728,257 | A | 3/1988 | Handschuh | |
| 5,080,556 | A * | 1/1992 | Carreno | 415/170.1 |
| 5,456,576 | A * | 10/1995 | Lyon | 415/173.3 |
| 5,934,684 | A * | 8/1999 | Brandon et al. | 277/421 |
| 6,142,731 | A * | 11/2000 | Dewis et al. | 415/136 |
| 6,514,041 | B1 | 2/2003 | Matheny et al. | |
| 6,733,235 | B2 * | 5/2004 | Alford et al. | 415/173.1 |
| 7,052,235 | B2 * | 5/2006 | Alford et al. | 415/173.1 |
| 2004/0071548 | A1 | 4/2004 | Wilson, Jr. | |

FOREIGN PATENT DOCUMENTS

| | | |
|---|---|---|
| EP | 0266235 | 5/1988 |
| EP | 0651139 | 5/1995 |
| EP | 1076161 | 2/2001 |
| EP | 1118806 | 7/2001 |
| EP | 1350927 | 10/2003 |
| GB | 839325 | 6/1960 |
| GB | 2397102 | 7/2004 |

OTHER PUBLICATIONS

European Search Report dated Feb. 24, 2009.

* cited by examiner

*Primary Examiner* — Nathaniel Wiehe
(74) *Attorney, Agent, or Firm* — Carlson, Gaskey & Olds, P.C.

(57) ABSTRACT

A blade outer air seal system includes a body that extends between two circumferential sides, a leading edge and a trailing edge, and a radially inner side and a radially outer side. An attachment section associated with the body and includes at least one engagement surface that is transverse to the radially outer side.

1 Claim, 4 Drawing Sheets

REPLACEABLE BLADE OUTER AIR SEAL DESIGN

BACKGROUND OF THE INVENTION

This invention relates to a blade outer air seal ("BOAS") system and, more particularly, to a blade outer air seal system having one or more replaceable members serving as the gas path surface. This scheme allows easy replacement of that portion of the BOAS that is routinely damaged from service usage.

Conventional gas turbine engines are widely known and used to propel aircraft and other vehicles. Typically, gas turbine engines include a compressor section, a combustor section, and a turbine section that cooperate to provide thrust in a known manner.

Typically, a blade outer air seal is located radially outwards from the turbine section and functions as an outer wall for the hot gas flow through the gas turbine engine. Due to large pressures and contact with hot gas flow through the turbine section, the blade outer air seal is typically made of a strong, oxidation-resistant metal alloy and requires a cooling system to keep the alloy below a certain temperature. For example, relatively cool air is taken from an air flow through the engine and routed through an intricate system of cooling passages in the seal to maintain a desirable seal temperature. Although effective, taking air from the engine air flow contributes to engine inefficiency by reducing engine thrust, and forming the seal with the cooling passages adds to the expense of the seal.

Accordingly, there is a need for a simplified and less expensive blade outer air seal that also reduces the need for cooling. This disclosed examples address these needs and provide enhanced capabilities while avoiding the shortcomings and drawbacks of the prior art.

SUMMARY OF THE INVENTION

An example blade outer air seal system includes a body that extends between two circumferential sides, a leading edge and a trailing edge, and a radially inner side and a radially outer side. An attachment section associated with the body and includes at least one engagement surface that is transverse to the radially outer side. For example, the attachment section has a dovetail shape.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
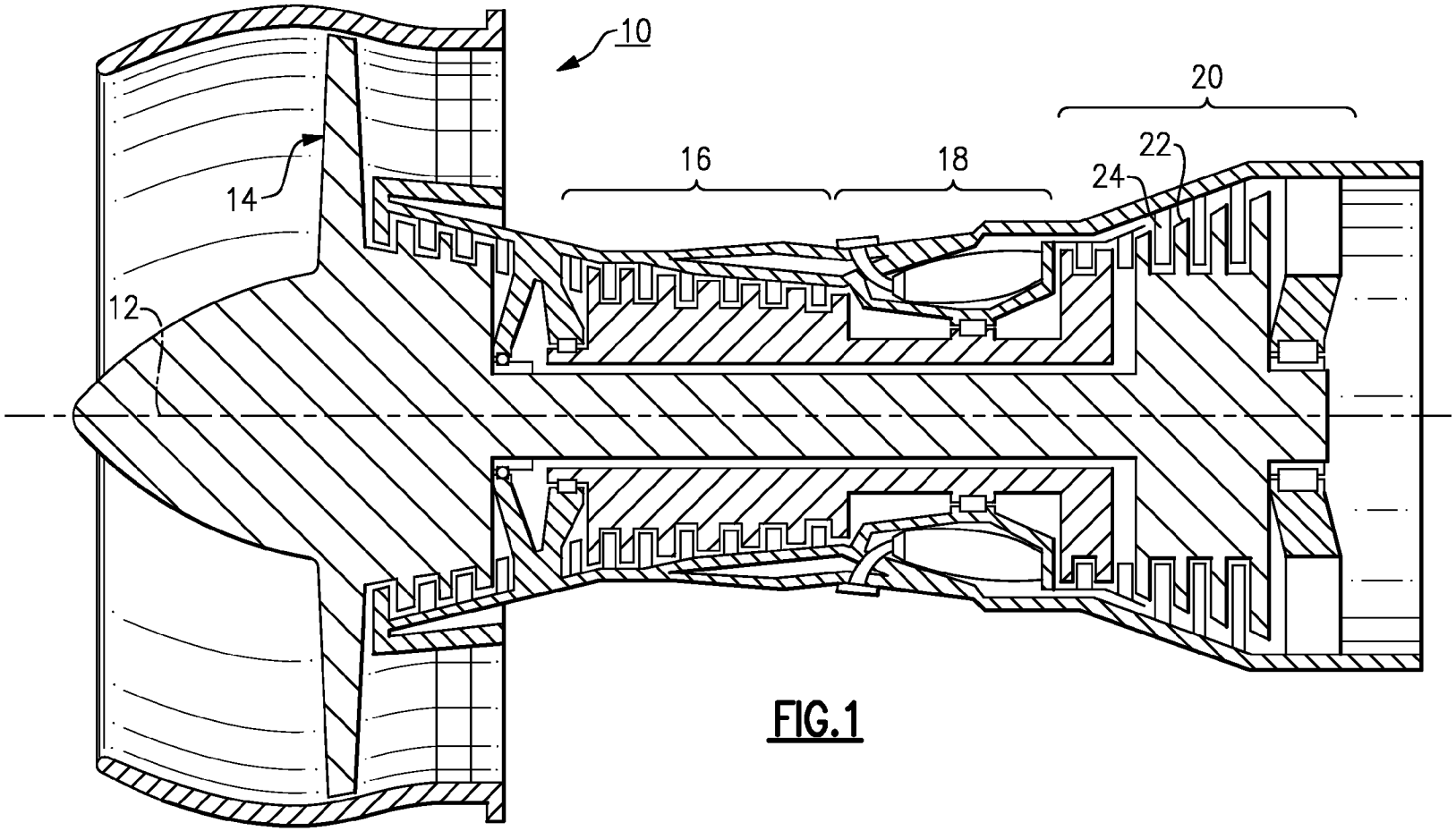
FIG. 1 is a schematic view of an example gas turbine engine.

FIG. 1 illustrates selected portions of an example gas turbine engine 10, such as a gas turbine engine 10 used for propulsion. In this example, the gas turbine engine 10 is circumferentially disposed about an engine centerline 12. The engine 10 includes a fan 14, a compressor section 16, a combustion section 18 and a turbine section 20 that includes turbine blades 22 and turbine vanes 24. As is known, air compressed in the compressor section 16 is mixed with fuel that is burned in the combustion section 18 to produce hot gases that are expanded in the turbine section 20. FIG. 1 is a somewhat schematic presentation for illustrative purposes only and is not a limitation on the disclosed examples. Additionally, there are various types of gas turbine engines, many of which could benefit from the examples disclosed herein, which are not limited to the design shown.

Figure 2:
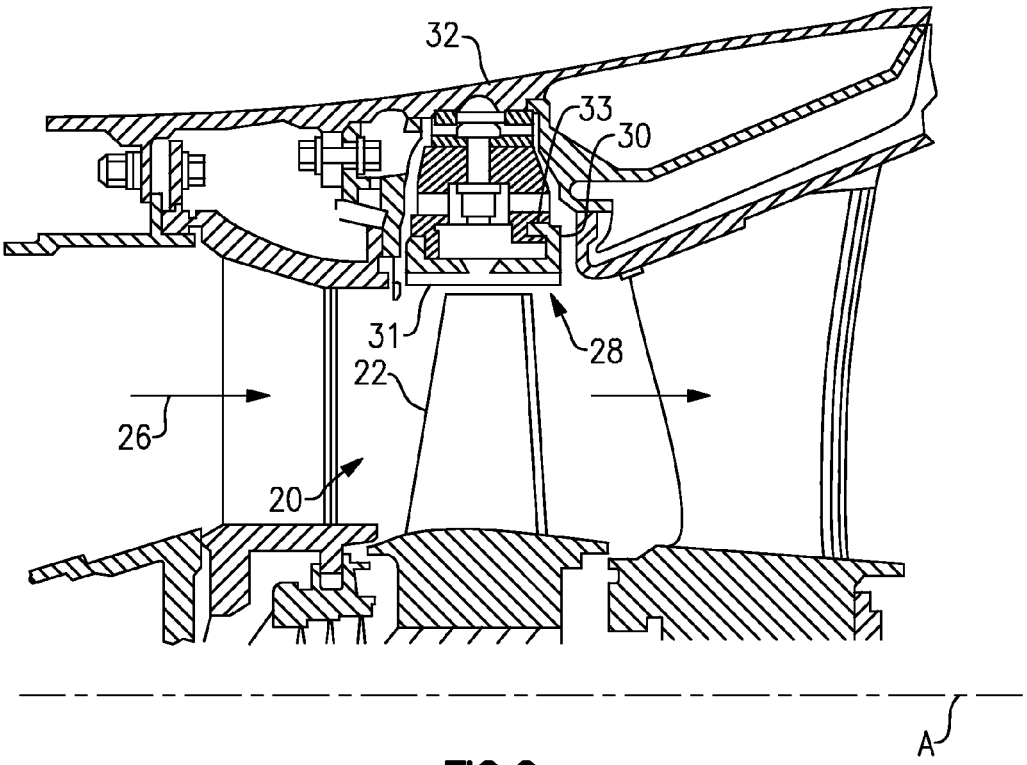
FIG. 2 is a selected portion of a turbine section of the gas turbine engine of FIG. 1.

FIG. 2 illustrates a selected portion of the turbine section 20. The turbine blade 22 receives a hot gas flow 26 from the combustion section 18 (FIG. 1). The turbine section 20 includes a blade outer air seal system 28 having an insert member 31 that functions as an outer wall for the hot gas flow 26 through the turbine section 20. In the disclosed example, the insert member 31 is removably secured to a support 30 that includes L-shaped hooks 33 extending therefrom to secure the support 30 to a case 32 that generally surrounds the turbine section 20. In one example, a plurality of insert members 31 are circumferentially located about the turbine section 20.

Figure 3:
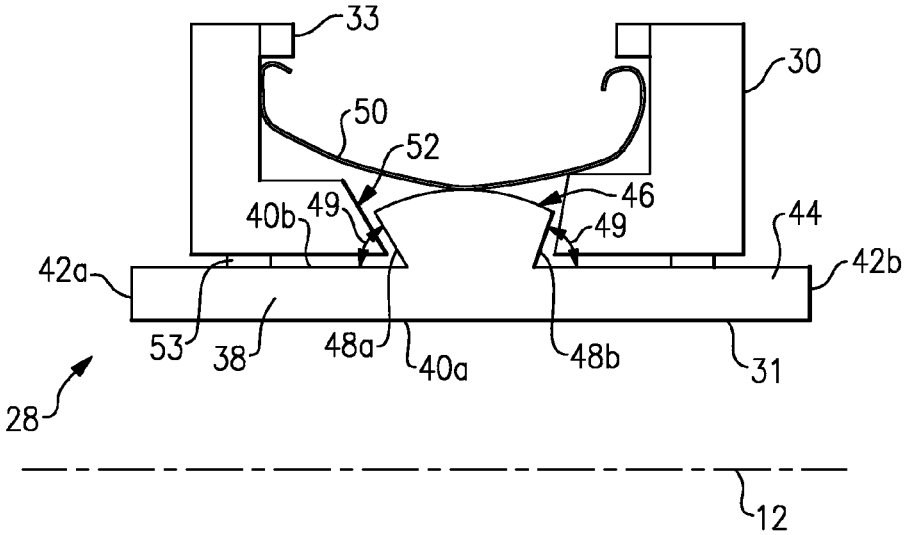
FIG. 3 is a circumferential view of an example blade outer air seal system.

Referring to FIG. 3, the insert member 31 includes a body 38 that extends between a radially inner side 40*a* and a radially outer side 40*b*. The body 38 also includes a leading edge 42*a*, a trailing edge 42*b* and two circumferential sides 44 (one shown).

In this example, the body 38 includes an attachment section 46 that extends radially outwards from the radially outer side 40*b*. The attachment section 46 includes engagement surfaces 48*a* and 48*b* for securing the blade outer air seal 28 to the support 30. Each of the engagement surfaces 48*a* and 48*b* forms an acute angle 49 with the radially outer side 40*b* of the body 38. In one example, the acute angle 49 is less than 90°.

In the illustrated example, the attachment section 46 is in the shape of a dovetail. The dovetail attachment feature has a lesser surface area and therefore reduces loads, inherent from the pressure differential between surfaces 40*a* and 40*b*.

The attachment section 46 is circumferentially slidably receivable into a corresponding section 52 of the support 30 to secure the insert member 31 and the support 30 together. The insert member 31 can thereby be removed and replaced simply by sliding it out of engagement with the support 30.

Optionally, a bias member 50 located between the insert member 31 and the support 30 biases the insert member 31 in a radially inward direction such that the engagement surfaces 48*a* and 48*b* engage the section 52 of the support 30. The bias member 50 provides the benefit of sealing the engagement surfaces 48*a* and 48*b* against the section 52 of the support 30 when the pressure differential from the hot gas flow 26 is not enough to seal the insert member 31 against the support 30, such as during initial startup of the gas turbine engine 10.

Optionally, seal members 53 are located between the support 30 and the insert member 31 to minimize leakage of cooling air and prevent hot gas ingestion into the region between the support 30 and the insert member 31. In one example, the seals 53 are feather seals that include a strip of sheet metal.

Figure 4:
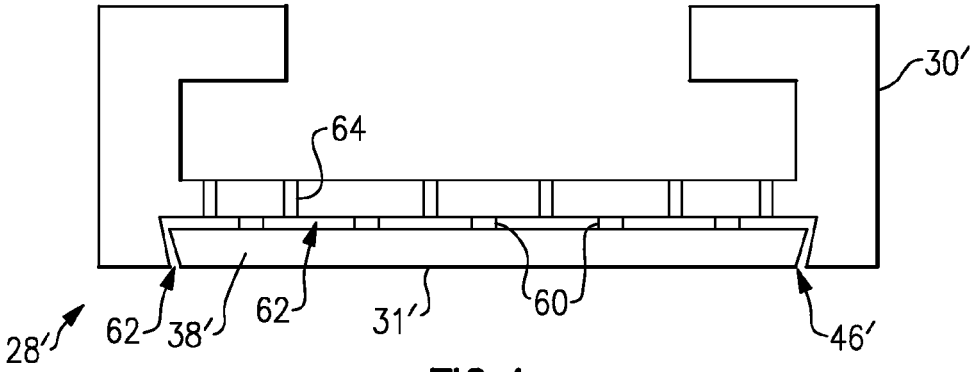
FIG. 4 is another example of a blade outer air seal system.

FIG. 4 illustrates selected portions of another example embodiment of the blade outer air seal system 28' wherein the insert member 31' includes a body 38' and an attachment section 46' that slidably secures to support 30'. In this example, spacers 60 located between the insert member 31' and the support 30' space the insert member 31' apart from the support 30' such that there is a passage 62 therebetween. In one example, the spacers 60 are integral with the insert member 31'. In the illustrated example, a coolant is conveyed through the cooling passages 64 within the support 30' and through the passage 62 to cool the insert member 31'.

Figure 5:
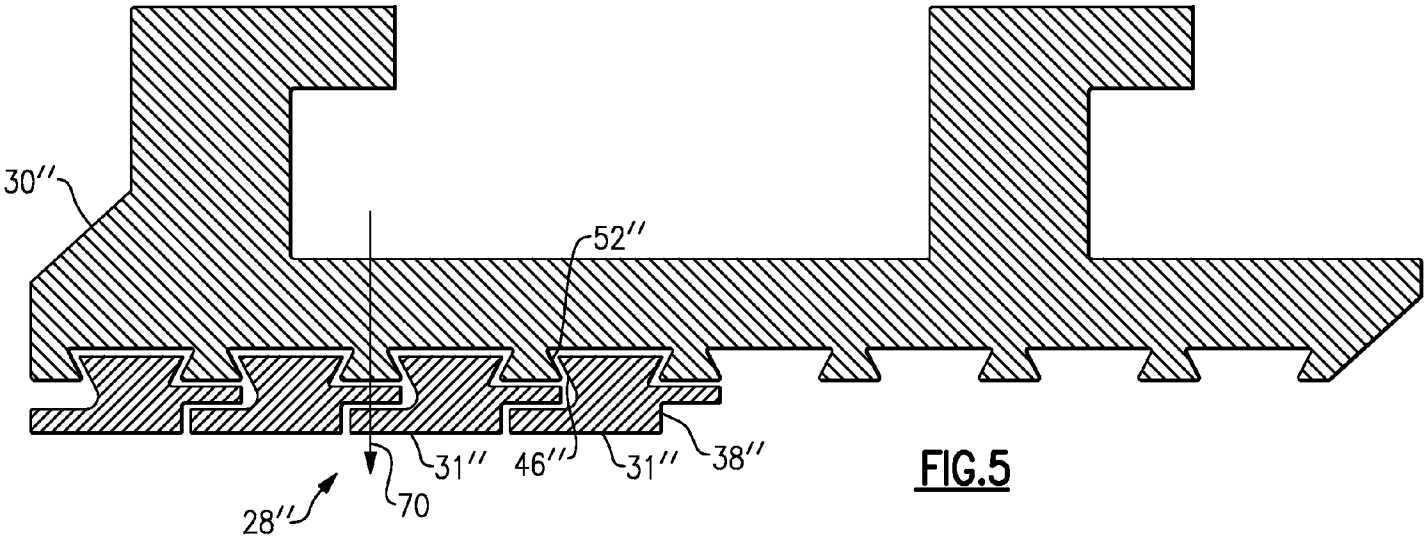
FIG. 5 is another example having a plurality of blade outer air seal members secured to a single support.

FIG. 5 illustrates another embodiment of the blade outer air seal system 28" in which multiple insert members 31" are attached to a single support 30". In this example, each of the insert members 31" includes a body 38" having an attachment section 46" that is slidably secured into a corresponding section 52" of the support 30", similar to as described for the example shown in FIG. 3. In this example, the insert members 31" overlap along direction 70. The overlapping of the insert members 31" provides the benefit of protecting the underlying support 30" from the heat of the hot gas flow 26.

In one example, the blade insert member 31, 31', 31" is made of a different material than the support 30, 30', 30". For example, the insert member 31, 31', 31" is made of a ceramic material and the support 30, 30', 30" is made of a metal or metal alloy. In one example, the insert member 31, 31', 31" is made of silicon carbide. In another example, the silicon carbide includes metallic regions dispersed there through.

The ceramic material provides the benefit of relatively high temperature resistance compared to the metal or metal alloy and, in some examples, eliminates or reduces the need for cooling using cooling air. Thus, the disclosed example blade outer air seal inserts 28, 28', 28" permit simplified designs without a need for complex cooling passages. Additionally, the ceramic material provides a relatively high degree of wear resistance, such as for contact with the turbine blades 22 during an initial engine run-in.

Figure 6:
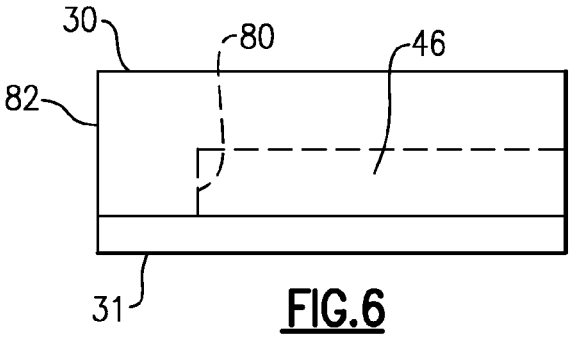
FIG. 6 is an axial cross-sectional view of an example blade outer air seal system secured to a support, wherein the support includes a stop to prevent circumferential movement of a blade outer air seal member.
Figure 7:
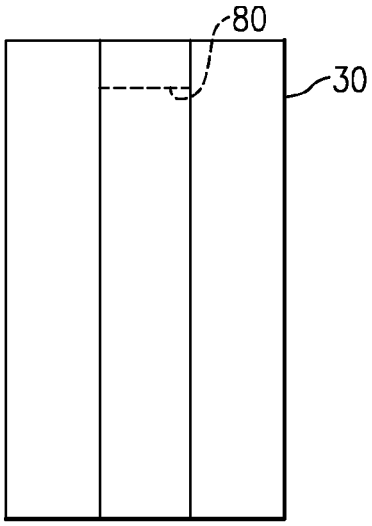
FIG. 7 is a circumferential cross-sectional view of the support shown in FIG. 6.
Figure 9:
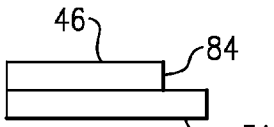
FIG. 9 is a lateral view of the blade outer air seal member shown in FIG. 8.
Figure 8:
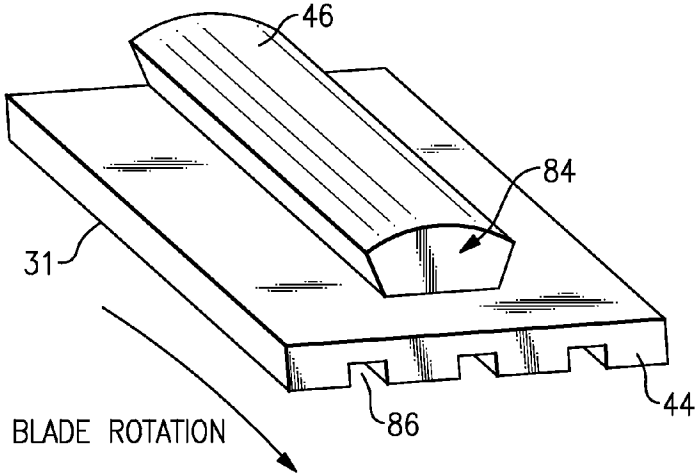
FIG. 8 is a perspective view of a blade outer air seal member that abuts the stop of the support shown in FIG. 6.

Referring to FIGS. 6 and 7, the support 30 optionally includes a stop section 80 near circumferential side 82 of the support 30. In this example, the stop section 80 abuts a circumferential side 84 of the attachment section 46 of the insert member 31, which is in the perspective view of FIG. 8 and the lateral view of FIG. 9. As shown, the circumferential side 84 defines a step such that the circumferential side 84 is spaced apart from one of the circumferential sides 44 of the body 38. The stop section 80 provides the benefit of restricting circumferential movement of the blade outer air seal insert 28 in at least one circumferential direction. Likewise, the supports 30' and 30" may also optionally include similar stops. Additionally, any of the insert members 31, 31', 31" may also include circumferential grooves 86 to reduce interaction area with the turbine blades 22.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A blade outer air seal system comprising:

a blade outer air seal having a body extending between two circumferential sides, a leading edge and a trailing edge, and a radially inner side and a radially outer side, an attachment section associated with the body, the attachment section having at least one engagement surface that is transverse to the radially outer side; and a support having at least one section that receives the attachment section to secure the support and the blade outer air seal together, the support including a stop that abuts one of the circumferential sides of the attachment section to restrict movement of the blade outer air seal in a circumferential direction, wherein the attachment section includes a first end that is flush with one circumferential side of the body and a second end that is spaced apart from the other circumferential side of the body, the second end abutting the stop of the support.

* * * * *